US008459279B1

(12) United States Patent
Jermyn

(10) Patent No.: US 8,459,279 B1
(45) Date of Patent: Jun. 11, 2013

(54) SPRAY NOZZLE TIP ADAPTER AND METHOD OF CLEANING PAINT SPRAY NOZZLE

(75) Inventor: Richard A. Jermyn, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 88 days.

(21) Appl. No.: 12/807,376

(22) Filed: Sep. 3, 2010

(51) Int. Cl.
*B08B 9/032* (2006.01)

(52) U.S. Cl.
USPC ..... 134/114; 134/166 R; 134/166 C; 134/167 C

(58) Field of Classification Search
None
See application file for complete search history.

(56) References Cited

U.S. PATENT DOCUMENTS

| | | | | |
|---|---|---|---|---|
| 4,784,170 | A * | 11/1988 | Romanelli et al. | 134/113 |
| 5,676,184 | A * | 10/1997 | Houser | 141/90 |
| 6,273,478 | B1 * | 8/2001 | Benett et al. | 285/346 |
| 2003/0089743 | A1 * | 5/2003 | Py et al. | 222/386 |

* cited by examiner

*Primary Examiner* — Michael Kornakov
*Assistant Examiner* — Ryan Coleman
(74) *Attorney, Agent, or Firm* — James T. Shepherd

(57) ABSTRACT

A spray nozzle tip adapter for cleaning a paint spray nozzle includes a rigid body member having an inlet port having annular sealing surfaces on one side, an exit port having annular sealing surfaces on another side and a passage connecting the inlet port and the exit port. The inlet port is shaped and sized to frictionally engage in a sealed relationship differently sized dispensing tubes of pressurized liquid solvent cans, and the exit port is shaped and sized to frictionally engage and retain a tubular inlet of a spray paint nozzle in a sealed relationship. The passage is shaped and sized to control a sealed flow of liquid to the nozzle and has a tapered region connected to the exit port to frictionally engage and retain a tubular inlet of a spray paint nozzle in a sealed relationship.

1 Claim, 3 Drawing Sheets

SPRAY NOZZLE TIP ADAPTER AND METHOD OF CLEANING PAINT SPRAY NOZZLE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

This invention relates to an adapter for cleaning a paint spray nozzle in an environmentally friendly and effective method. More particularly, the invention is for a device and method for cleaning typical paint spray nozzles having usual male type inlets by propelling pressurized liquid solvent through the nozzles instead of the usual practice of cleaning or attempting to clean the nozzles by using gaseous aerosol from the container of the paint product.

Paint nozzles from aerosol spray paint cans are commonly "cleaned" or cleared of residual paint-product material by inverting the aerosol paint can, depressing the nozzle for pressurized release/activation, and holding the nozzle depressed for at least three or more seconds while aerosol propellant passes through the nozzle. This action is continued until the operator perceives a cleaned nozzle by sight, sound or time, or assumes that the paint nozzle is sufficiently clean. At minimum, large amounts of propellant are expelled into the atmosphere along with some quantity of paint. Often however, large amounts of paint-product are also expelled with the aerosol because of various reasons including overfill of paint, failure to hold the can fully inverted, location of the internal tube of the nozzle below the inside surface of paint, or paint being "drawn by air flow" into the internal tube. Consequently, the paint spray nozzle often is not fully cleaned or not cleaned at all, and nothing has been gained by this type cleaning procedure.

The propellant often used today is carbon dioxide, but by today's standards, carbon dioxide is considered by many to be an environmental hazard or greenhouse gas. Because manufacturers anticipate the excessive discharge of propellant during the previously described cleaning procedure, the aerosol paint cans are additionally over-charged with propellant such that the user will not become frustrated with insufficient propellant. The excessive discharged propellant is considered to be unnecessarily polluting to the environment.

Thus, in accordance with this inventive concept, a need has been recognized in the state of the art for a spray tip nozzle adapter for cleaning typical paint spray nozzles having usual male type inlets by propelling pressurized liquid solvent through the nozzles.

SUMMARY OF THE INVENTION

The present invention provides a spray nozzle tip adapter and method for cleaning paint spray nozzles and has a rigid body member having an inlet port on one side, an exit port on another side, a passage connecting the inlet port and the exit port and a cupped contact surface on the rigid body member for exerting compressive force. The rigid body member is formed in an L-shape and the passage is formed in an internal L-shape including a ninety degree angle between the inlet port and the exit port. The inlet port has an outer annular portion and a smaller inner annular portion. This sizing permits the outer and inner annular portions to frictionally engage differently sized dispensing tubes of pressurized liquid solvent cans in a sealed relationship. The exit port has an annular exit portion shaped and sized to frictionally engage and retain a tubular inlet of a spray paint nozzle in a sealed relationship. The passage has a tapered region of tapered diameter that is connected to the annular exit portion of the exit port to frictionally engage and retain a tubular inlet of a spray paint nozzle in a sealed relationship.

The method of cleaning a paint spray nozzle calls for inserting the stem of a fouled paint spray nozzle into an exit port of a spray nozzle tip adapter. Next, inserting the solvent dispensing tube of a can of pressurized liquid solvent into an inlet port of a spray nozzle tip adapter allows pushing the spray nozzle tip adapter onto the solvent dispensing tube and propelling liquid solvent through a passage in the spray nozzle tip adapter to clean fouling from the paint spray nozzle.

An object of the invention is to provide an apparatus to utilize commercially available pressurized liquid solvents propelled through usual male type dispensing tubes to clean paint spray nozzles.

Another object of the invention is to provide an apparatus allowing secure connection to a solvent dispensing tube of a container of pressurized liquid solvent to dispense solvent through the dispensing tube in the usual way to dispense solvent.

Another object of the invention is to provide an apparatus allowing secure connection to a solvent dispensing tube of a container of pressurized liquid solvent to dispense the solvent at a desired angle and flow to clean paint spray nozzles.

Another object of the invention is to provide a spray nozzle tip adapter directing gas pressurized liquid solvents from usual male type dispensing tubes through typical paint spray nozzles having usual male type inlets in a safe and controlled manner to clean the spray nozzles.

Another object of the invention is to provide a spray nozzle tip adapter directing pressurized liquid solvents to thoroughly clean paint spray nozzles and make them free of residual paint and prevent clogging from dried paint during future use.

Another object of the invention is to provide a spray nozzle tip adapter directing gas pressure-propelled liquid solvents to clean paint spray nozzles that allows capture of a small volume of released paint and solvent as a liquid into a waste container or rag for disposal in a more environmentally friendly manner than contemporary methods that release paint and propellant as vapor, mist or droplets into the gaseous atmosphere where they are harder to capture and reclaim.

Another object of the invention is to provide a spray nozzle tip adapter directing gas pressurized, propelled liquid solvents to clean paint spray nozzles to prevent spraying aerosol propellant and paint into the atmosphere.

Another object of the invention is to provide a spray nozzle tip adapter directing gas pressurized, propelled liquid solvents to more effectively clean and prepare fouled paint nozzles such that the paint products work more effectively and are more resource efficient, i.e. with better, more consistent results with less rework and less waste.

Another object of the invention is to provide a spray nozzle tip adapter directing pressurized-propelled liquid solvents to clean paint spray nozzles allowing use of many different, available dispensing tubes of solvents.

These and other objects of the invention will become more readily apparent from the ensuing specification when taken in conjunction with the appended claims.

DESCRIPTION OF THE PREFERRED EMBODIMENT

Figure 1:
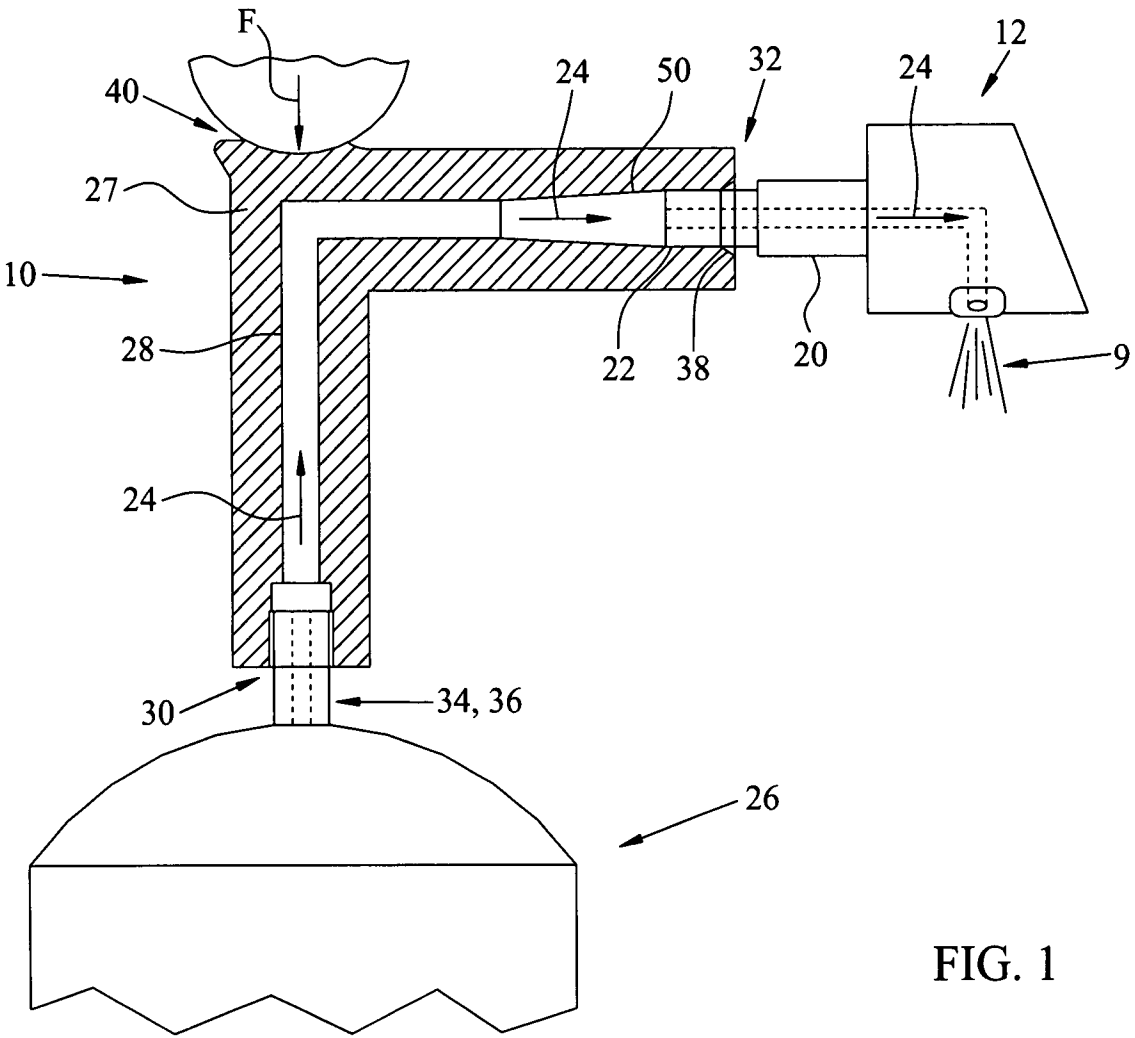
FIG. 1 is a cross sectional side view of the spray nozzle tip adapter of the invention connected to a typical paint spray nozzle and a can of gas pressurized liquid solvent.
Figure 2:
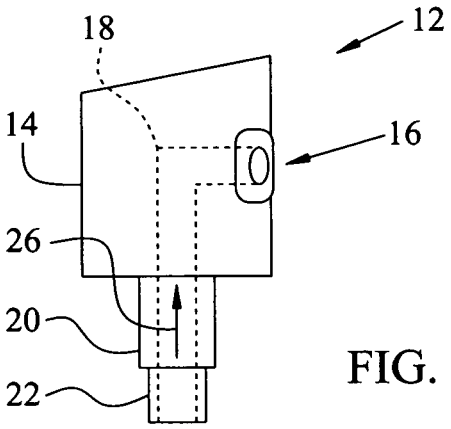
FIG. 2 is a side view of a typical male type paint spray nozzle.

Referring to FIGS. 1 and 2, a spray nozzle tip adapter 10 of the invention is shown cleaning paint fouling 9 from a typical paint spray nozzle 12. Gas pressurized cans of paint having standardized paint spray nozzles 12 are widely known and universally used to apply paint on nearly any surface needing painting. Immediately after use, however, the nozzle must be cleaned of residual paint or the paint residue will dry in place to obstruct the nozzle and make it useless.

A typical paint spray nozzle 12 has a substantially cylindrical body 14 that positions a nozzle end 16 for discharging an aerosol paint spray to the side via a central aerosol duct 18 extending through an annular shoulder 20 and a central cylindrical male-type inlet 22. Spray nozzle tip adapter 10 propelling pressurized liquid solvent 24 from a can of pressurized liquid solvent 26 through paint spray nozzle 12 is far more effective and efficient for cleaning paint residue as compared to the usual practice of attempting to clean paint-fouled nozzles with gaseous aerosol from the paint container itself.

Figure 3:
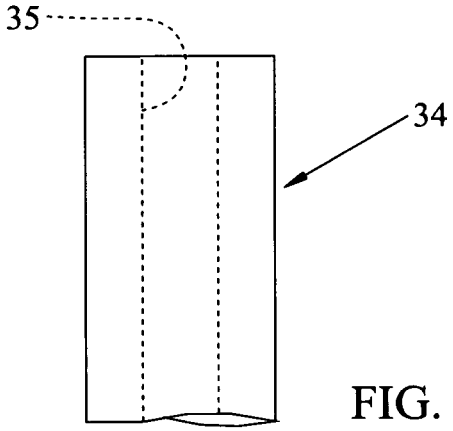
FIG. 3 is a side view of a simple male-type solvent dispensing tube of a can of gas pressurized liquid solvent showing its central solvent exit duct.
Figure 4:
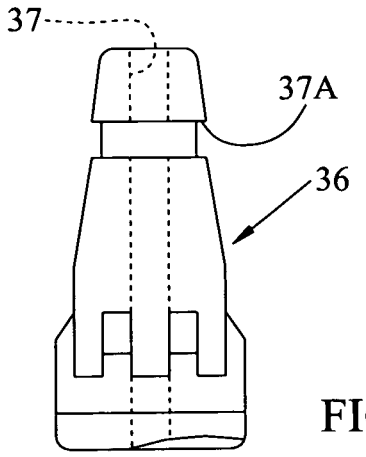
FIG. 4 is a side view of a complex male-type solvent dispensing tube of a can of gas pressurized liquid solvent showing its central solvent exit duct.

Spray nozzle tip adapter 10 has a rounded, elongate, L-shaped rigid plastic or metal body member 27. Body member 27 has an L-shaped internal passage 28 having an inlet port 30 and exit port 32 at its opposite ends. Referring also to FIGS. 3 and 4, inlet port 30 is shaped and sized to fit over and frictionally engage liquid dispensing tube 34 or 36 of liquid solvent can 26 in a sealed relationship. Dispensing tube 34 is a simple male-type having essentially a tubular shape with a coaxial solvent exit duct 35 and dispensing tube 36 is a complex male-type having a tapered or variable diameter outside surface and a coaxial solvent exit duct 37. Internal L-shaped passage 28 connects and provides a sealed flow passage for pressurized solvent 24 from either duct 35 or 37 between inlet port 30 and exit port 32 of spray nozzle tip adapter 10.

Figure 5:
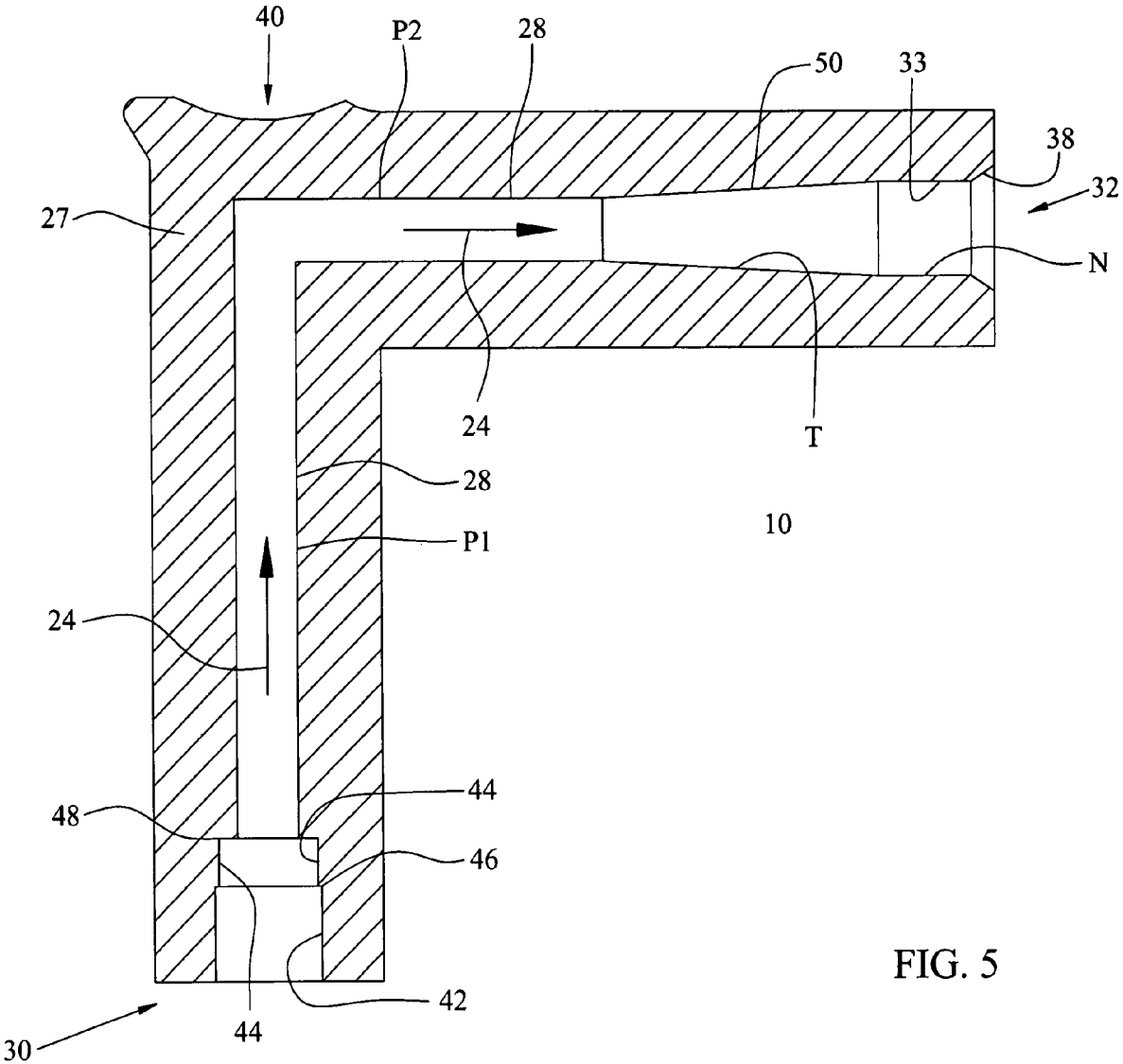
FIG. 5 is a cross sectional side view of the spray nozzle tip adapter of the invention showing details thereof.

Referring also to FIG. 5, exit port 32 has an annular exit portion 33 of exit diameter N sized to receive and frictionally engage and retain central tubular inlet 22 of paint spray nozzle 12 in a sealed relationship. A short bevel or similar tapered or stepped passage geometry 38 may be provided around the entrance to both inlet and exit ports 30 and 32 (no bevel or stepped passage geometry being depicted around inlet port 30). These geometries can assist with connecting/guiding the inlet and exit ports 30 and 32 onto the respective solvent dispensing tube 34 or 36 of can 26 and central inlet 22 of paint spray nozzle 12. A raised finger cupped contact surface 40 on the outside of body member 27 is centered over inlet port 30 and part of passage 28 to assist with an operator's downward pushing by finger F to exert a force F substantially parallel to solvent dispensing tube 34 or 36 and frictionally engage inlet port 30 of spray nozzle tip adapter 10 onto dispensing tube 34 or 36 of solvent can 26. Finger contact surface 40 also aids further pushing down upon solvent dispensing tube 34 or 36 to activate solvent can 26 to dispense pressurized liquid solvent 24 into passage 28.

Inlet port 30 is shaped with an outer annular portion 42 having an internal diameter sized to tightly fit and seal some larger diameter size solvent dispensing tubes 34 or 36 of cans 26. Inlet port 30 also is provided with an inner annular portion 44 having a smaller internal diameter than outer annular portion 42. This structure permits a smaller diameter dispensing tube 34 or 36 to be inserted into inlet port 30 to frictionally engage and create a second seal when contact with the top of tube 34 or 36 is made with inner portion 44 and/or a first annular shoulder 46 between outer and inner portions 42 and 44. The inside diameters of the inner and outer annular portions 42 and 44 are preferably larger than the diameter of passage 28. Either inner or outer annular portions 42 or 44 (or both) of inlet port 30 can optionally be provided with a well known ring-like resilient lock protrusion surface (not shown) extending radially inwardly to mate with a lock groove 37A on complex dispensing tube 36 to frictionally lock tube 36 in inlet port 30. Exerting further force of contact in the downward direction by depression of the finger cupped contact surface 40 results in release of pressurized liquid solvent 24 from can 26 through exit ducts 35 or 37 of tubes 34 or 36 and into passage 28.

Similarly, inner annular portion 44 has an internal diameter to tightly fit and seal some smaller diameter size dispensing tubes 34 or 36 of cans 26. Upon contact of smaller internal diameter inner annular portion 44 and/or a second annular shoulder 48 created around internal passageway 28 adjacent inner portion 44, yet another seal can be made with the contact of the top of solvent dispensing tubes 34 or 36. Again, exerting further force of contact in the downward direction by depression of finger cupped contact surface 40 activates can 26 to release propelled solvent 24 in the normal way which enters internal passage 28 of spray nozzle tip adapter 10. The forceful depression also seals the juncture between the solvent dispensing tube and the inner and outer portions of the inlet port to avoid blow-by of propelled liquid solvent. In this fashion, the spray tip nozzle tip adapter 10 fits onto and operates in conjunction with multiple size/types of liquid solvent cans 26.

Passage 28 has a first diameter of P1 to enable the released liquid solvent 24 to enter and flow inward where it makes an angle turn (normally 90 degrees). Passage 28 can have a second diameter of P2 downstream of the angle turn to help control the rate at which propelled solvent 24 then flows into annular exit portion 33 of outlet port 32. Diameters P1 and P2 of passage 28 are selectively sized to both limit/restrict flow of solvent 24 and to provide passage to a tapered region 50 of tapered exit diameter T in body member 27.

Tapered region 50 provides mating and smooth transition of the internal passage 28 having diameter P2 to exit diameter N of annular exit portion 33 of exit port 32. Exit diameter N is sized to receive and frictionally retain inlet 22 of paint spray nozzle 12 in a snug frictional, sealed engagement in exit port 32. This snug engagement holds inlet 22 in place and enables pressurized liquid solvent 24 to be propelled from a can of pressurized liquid solvent 26 and through paint spray nozzle 12 during its cleaning.

To iterate this point, inlet 22 of paint spray nozzle 12 to be cleaned is inserted with force into annular exit portion 33 of exit port 32 and tapered region 50. Both diameter N of exit port 32 and tapered diameter T are sized to tightly fit on inlet 22 and therefore seal the outer diameter of inlet 22 in exit port 32 of spray tip nozzle adapter 10. Further forceful insertion of inlet 22 of paint spray nozzle 12 causes the end of inlet 22 to further be pressed into contact with the smaller diameter T of tapered region 50 in body member 27 and creates a second tighter seal that also holds paint spray nozzle 12 in place and avoids blow-by of propelled liquid solvent 24. Once paint spray nozzle 12 is fitted into annular exit portion 33 of exit port 32 and/or into tapered region 50, nozzle end 16 of paint spray nozzle 12 can be rotated to any desired orientation. A preferred orientation for safe cleaning is most likely to be with nozzle end 16 of paint nozzle 12 pointing downward. Dispensed solvent and waste paint can be captured directly into a waste container or cloth rag for environmentally friendly disposal.

Paint spray nozzle tip adapter 10 can be used to clean other than paint spray nozzles 12, such as other product dispensing straws/tubes that can be inserted and sealed in the tapered region 50 to propel solvent 24 through in the usual manner. This is because the design of relatively long tapered region 50 seals and holds a clean or fouled dispensing tube more securely than a relatively short straight exit diameter. In addition, spray nozzle tip adapter 10 can be used with a can 26 of pressurized liquid solvent in inlet port 30 and a paint spray nozzle 12 in exit port 32 to dispense a spray of solvent 24 through nozzle 12 when such a spray is needed.

Paint spray nozzle adapter 10 seals more than one size of simple and complex male dispensing tubes 34 and 36 of cans 26 in inlet port 30 to male type inlet tubes 22 in exit port 32. This allows use of spray tip nozzle adapter 10 with many currently available dispensing tubes for cans of liquid solvent. In addition to perimeter sealing surfaces within spray tip nozzle adapter 10, secondary sealing surfaces are provided where reduced diameters are internally provided. For example, secondary sealing surfaces are formed on the inner diameter surface for both inner portion 44 and first annular shoulder 46, the inner diameter surface for outer portion 42 and second annular shoulder 48, and the tapered inner diameter surface for tapered region 50 and inner diameter surface of annular exit portion 33 of exit port 30.

Spray nozzle tip adapter 10 provides a typically horizontal exit flow direction for propelled liquid solvent 24 to prevent any unrestricted solvent flow that might possibly be directed toward the user's eyes. By virtue of length, turn, taper, and diameter of all passages, the solvent flow rate is at safer manageable amounts and uncontrolled flow rates are avoided.

Spray nozzle tip adapter 10 is not restricted to the specific arrangement referred to above but can be modified in accordance with this inventive concept to assure superior cleaning of paint spray nozzles and other tubes and to dispense solvent. It can have the inlet and exit ports as described, but can be modified to deviate from the angle of the L-shape described above and/or can have a shorter tubular shape of as small as 0.3 inch with a straight-through passage of uniform or non-uniform diameter of as small as 0.125 inch. It might also be modified to do away with the tapered diameter portion or may have any combination of the features described above, so long as the modified design of spray nozzle tip adapter 10 seals and feeds propelled liquid solvents 24 to and through typical paint spray nozzles 12 in a safe and controlled manner to clean them of residual paint and not be clogged by dried paint.

The disclosed components and their arrangements as disclosed herein, all contribute to the novel features of this invention. Therefore, spray nozzle tip adapter 10, as disclosed herein, is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. An apparatus for cleaning a nozzle comprising:

a L-shape rigid body member having an inlet port and an exit port at opposite ends thereof, and a L-shaped internal passage extending between said inlet port and said exit port;

wherein said inlet port has (i) an outer annular portion disposed at the entrance of said inlet port, said outer annular portion being coaxially aligned with said passage and having a constant diameter larger than the diameter of said passage, and (ii) an inner annular portion disposed between said outer annular portion and said passage, said inner annular portion being co-axially aligned with said passage, and having a constant diameter larger than the diameter of said passage and smaller than the diameter of said outer annular portion;

wherein a first flat shoulder portion is formed at a junction of said outer annular portion and said inner annular portion, and a second flat shoulder portion is formed at a junction of said inner annular portion and said passage;

wherein the diameters of said inner and outer annular portions are configured to fit differently-sized dispensing tubes of cans of pressurized solvent and the first and second flat shoulder portions limit insertion of the dispensing tubes into said passage, creating a seal between the end of a dispensing tube and a shoulder portion;

wherein said exit port has (i) an annular beveled region at the exit of said exit port, said beveled region having a large diameter and a small diameter, and (ii) an annular exit portion disposed between said beveled region and said passage, said exit portion being co-axially aligned with said passage, and having a constant diameter equal to the small diameter of said beveled region and larger than the diameter of said passage;

wherein said passage has a tapered region adjacent to said annular exit portion, said tapered region having a large diameter and a small diameter, wherein said large diameter of said tapered region is equal to the diameter of said annular exit portion; and wherein said body member further comprises a cupped contact surface having a centerline substantially co-axially aligned with said inner and outer annular portions of said inlet port.

* * * * *